United States Patent [19]

Troue

[11] 4,048,490

[45] Sept. 13, 1977

[54] APPARATUS FOR DELIVERING RELATIVELY COLD UV TO A SUBSTRATE

[75] Inventor: Harden Henry Troue, Plainfield, Ind.

[73] Assignee: Union Carbide Corporation, New York, N.Y.

[21] Appl. No.: 694,972

[22] Filed: June 11, 1976

[51] Int. Cl.[2] ..... F21V 7/12

[52] U.S. Cl. ..... 240/41.35 D; 240/47; 240/103 R; 250/504

[58] Field of Search ..... 240/41.1, 41 C, 41.35 C, 240/41.35 D, 41.35 R, 103 R, 47, 1 A, 1.4, 41.36; 350/1, 290; 250/504, 503, 495, 527

[56] References Cited

U.S. PATENT DOCUMENTS

| | | | |
|---|---|---|---|
| 2,198,014 | 4/1940 | Ott | 240/41.1 |
| 3,745,325 | 7/1973 | Harvey | 240/41.35 R X |
| 3,769,503 | 10/1973 | Kim | 240/47 X |
| 3,819,929 | 6/1974 | Newman | 240/47 X |
| 4,005,135 | 1/1977 | Helding | 240/47 X |

*Primary Examiner*—L. T. Hix
*Assistant Examiner*—Kenneth C. Hutchison
*Attorney, Agent, or Firm*—Saul R. Bresch

[57] ABSTRACT

A dichroic filter system for delivering UV to induce crosslinking of photocurable organic compounds on a substrate, whereby substantially all the UV is reflected to the workpiece while undesired infra red light is transmitted and absorbed by a dichroic filter and absorber arrangement. The filters are arranged so that substantially all the UV light from a line source of light strikes a dichroic surface only once and substantially all the UV light leaving the system has struck a dichroic surface once.

2 Claims, 5 Drawing Figures

APPARATUS FOR DELIVERING RELATIVELY COLD UV TO A SUBSTRATE

This invention relates to the use of dichroic filters with ultraviolet light sources (UV) and more particularly to an apparatus incorporating a system of dichroic filters with a line source of UV so that the light leaving through the opening in the apparatus is substantially all UV.

Generally speaking, photocurable organic coating materials can be cured with low to moderate flux densities and frequently with UV of only one wave length. This type of energy can readily be generated by low wattage UV lamps (such as germicidal lamps) which are inherently efficient and relatively cold. However, when highly pigmented relatively thick coatings are to be cured it is necessary to provide a broad spectral distribution of UV and a high flux density. This can be readily obtained from higher wattage mercury lamps in the range of tens to hundreds of watts per inch of arc length. These lamps inherently generate a large amount of infra red (IR) which is manifested as heat on the substrate being cured. This of course in many cases makes the use of high wattage UV lamps unacceptable as a UV source because the heat will destroy the substrate to be cured, i.e., paper, plastic laminate, etc. Up until now, therefore, UV lamps were limited in their process applicability.

Accordingly, much effort has been expended in the art to develop a system for separating the UV light desired from the undersired IR light. Some solutions suggested involved the use of water filters. This solution depends on water purity which is difficult to maintain and consequently results in increased loss of UV through the water medium as purity decreases. Dichroics are known materials which are capable of separating light by reflecting one band of wave lengths while transmitting others. However, up until now, there has not been developed a commerical, feasible, economic system for using dichroic filters with high wattage mercury vapor lamps.

Accordingly, it is the main object of this invention to provide a UV light system incorporating dichroic filters which provide relatively cold UV light on a substrate having a coating to be cured.

It is another object to provide such a system which is compact, efficient and economical.

These and other objects will either be or become apparent from the following discussion and drawings wherein.

Figure 1:
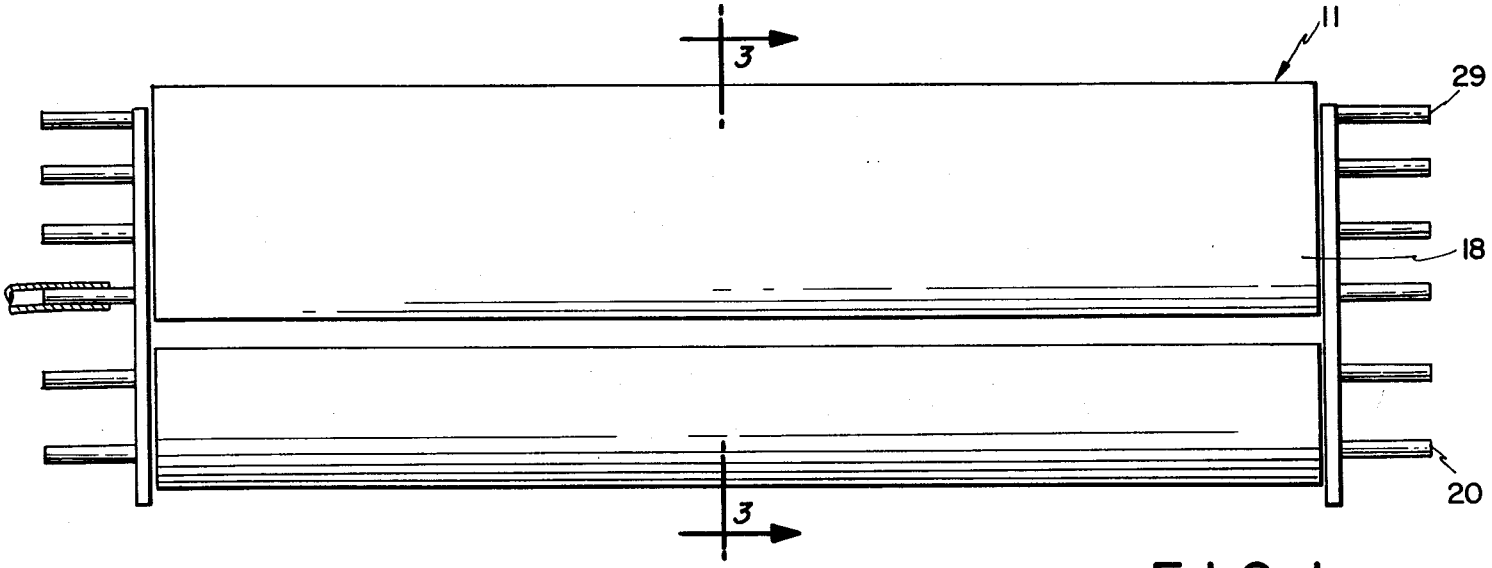
FIG. 1 is front elevation view of the exterior of apparatus of the invention without the light assembly.
Figure 2:
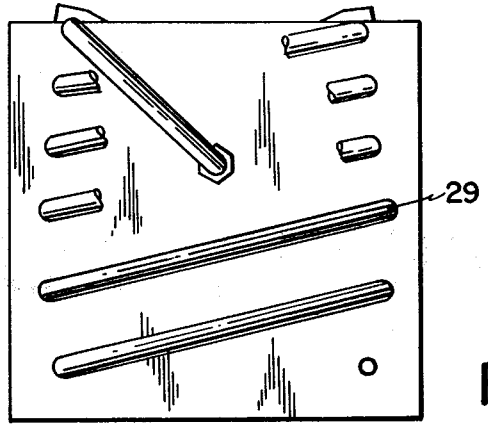
FIG. 2 is a side view of the apparatus shown in FIG. 1 illustrating the water cooling passages associated with the apparatus.
Figure 3:
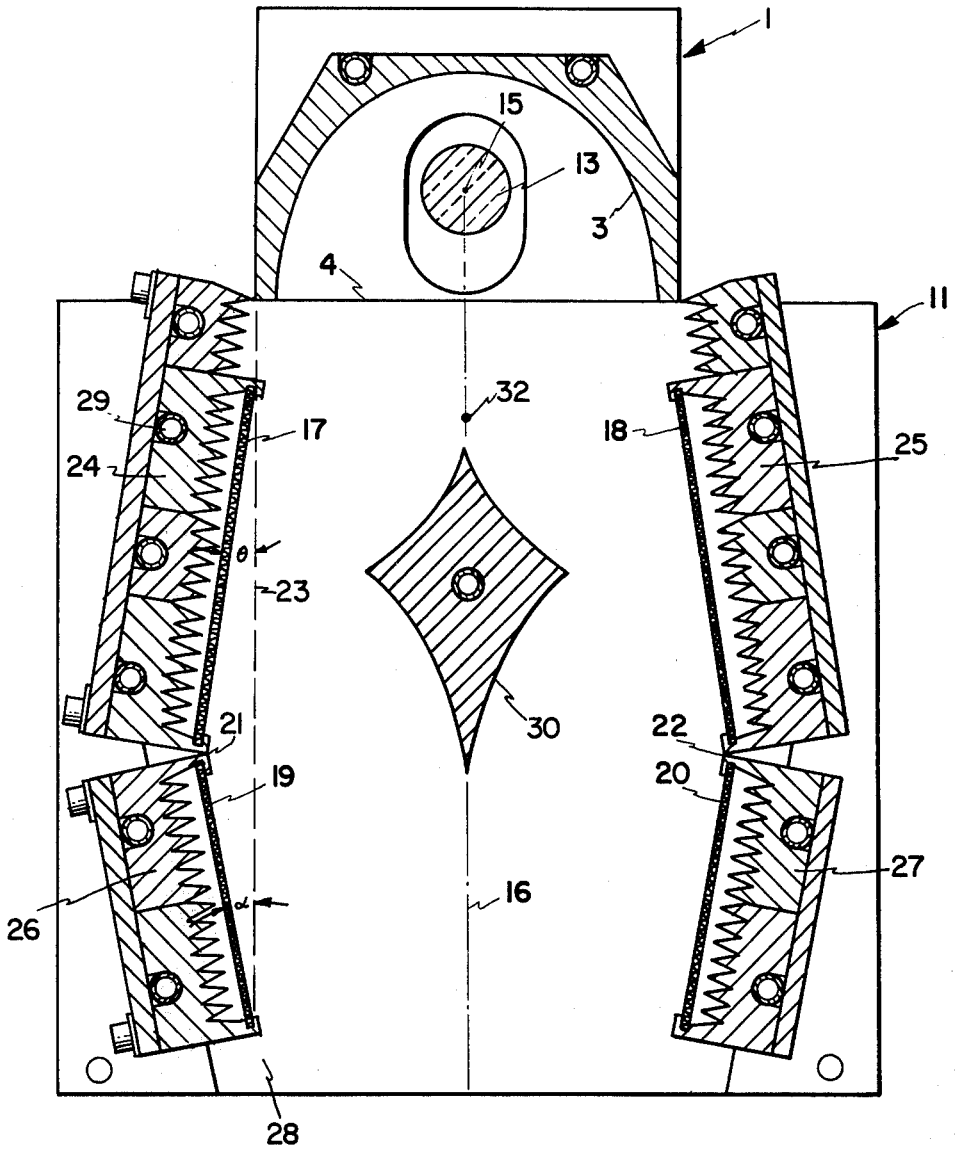
FIG. 3 is a cross-sectional view of a preferred embodiment of the apparatus shown in FIG. 1 taken along the line 3—3.
Figure 4:
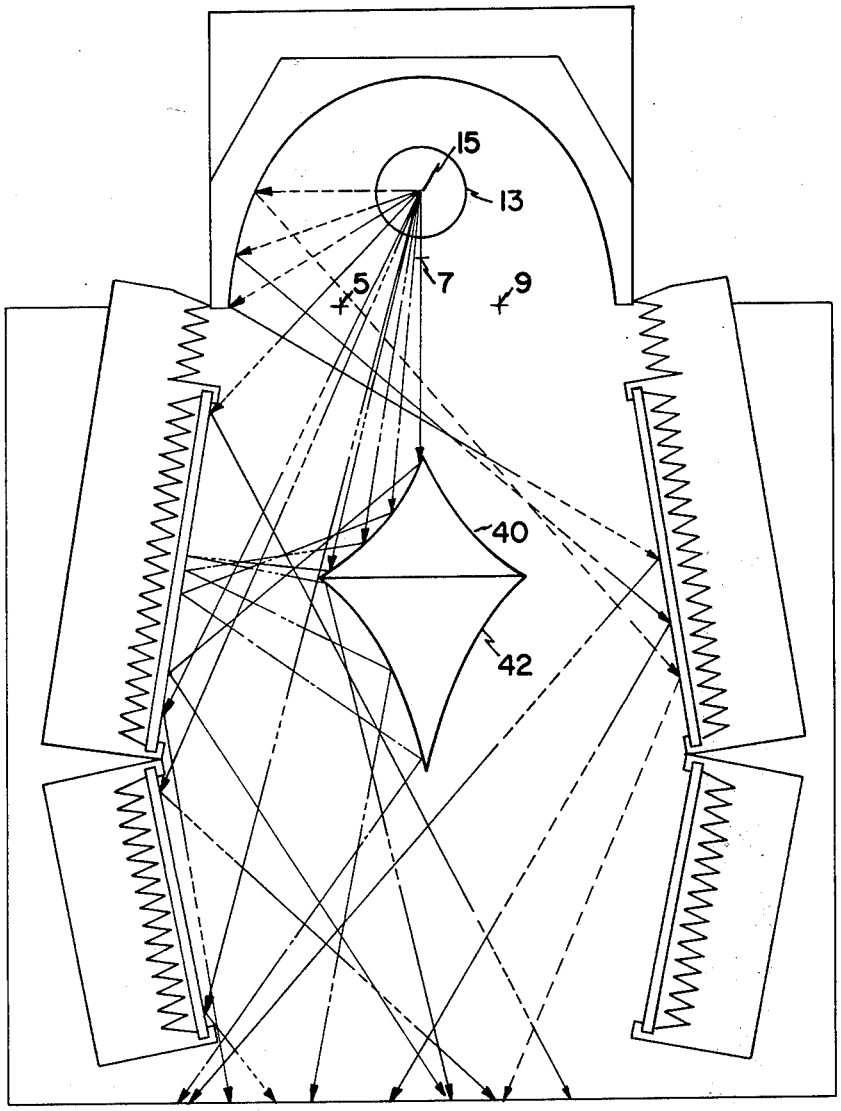
FIGS. 4 and 5 are illustrations of typical light ray paths of light emanating from the quadrants of the light as shown.
Figure 5:
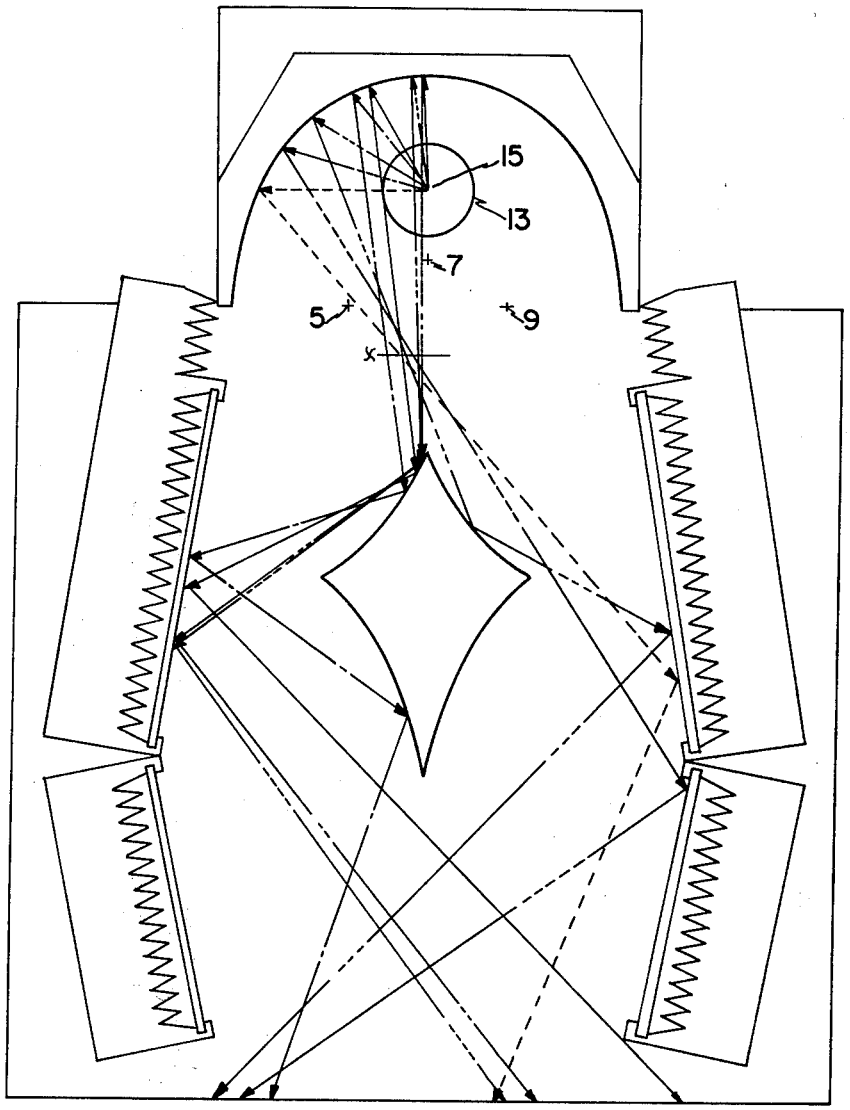

Referring now to the drawings and particularly FIGS. 1 and 3, a preferred embodiment of the apparatus of the invention includes in combination a lamp housing 1 having a reflective inner surface 3 and an opening 4. Surface 3 is made up of three cylindrical surfaces having their centers of curvature at points 5, 7 and 9, respectively as shown in FIGS. 4 and 5. The surface 3 therefore is an elliptical-like surface. For easy access to the dichroic filter assembly the housing 1 is removably mounted on the dichroic assembly 11 so that the opening 4 of housing 1 communicates with assembly 11. A high wattage mercury vapor lamp 13 is mounted in the housing 1 at the first focal line 15. The lamp housing 1 and assembly 11 comprising the apparatus have a plane of symmetry which is perpendicular to the plane of the opening 4. The plane of symmetry in FIG. 3 is represented by line 16. The longitudinal axis of the lamp 13 lies in the plane of symmetry 16.

The dichroic assembly 11 consists of first optically flat dichroic surfaces 17 and 18 mounted in assembly 11 on each side of the plane of symmetry 16 so that the first dichroic surfaces 17 and 18 will have one end thereof adjacent the lamp housing opening 4 when the lamp housing and dichroic assembly are combined for operation. Second, optically flat dichroic surfaces 19 and 20 are mounted in the assembly 11 on each side of the plane of symmetry 16 and connected to the other end 21 and 22 of dichroic filters 17 and 18, respectively, so that the surface 17 and 19 and 18 and 20 form a concave surface on each side of the plane of symmetry when viewed from the plane of symmetry. Preferably surfaces 17 and 18 are inclined toward the plane of symmetry at an angle $\theta$ of about 9°, such angle being measured between a line 23 parallel to the line 16 and the dichroic surfaces 17 and 18. Likewise surfaces 19 and 20 are inclined toward the plane of symmetry at an angle $\alpha$ of about 11°.

The dichroic surfaces 17 and 18 are mounted on aluminum extruded absorber members 24 and 25. The dichroic surfaces 19 and 20 are mounted on aluminum extruded absorber members 26 and 27. These absorber members have a surface adjacent the back side of the dichroic which is a saw tooth-like surface with about a 30 degree included angle between teeth.

Water cooling of the absorber surfaces is provided by passing cooling water through passages 29.

The assembly 11 is enclosed at each end by an end mirror surface 28.

A cusp-like member 30 is mounted in the assembly 11 between the dichroic surfaces 17, 19 and 18 and 20 respectively, so that its longitudinal plane of symmetry coincides with the plane of symmetry 16 of the apparatus. The cusp 30 is located along the plane of symmetry 16 beyond the second focal line 32 of the reflector housing 1. The reason for this position and for the cusp itself is to ensure that substantially all the light rays from the source 13 will be reflected off of a dichroic surface only once. Thus the cusp blocks the direct exit of unfiltered light (see FIGS. 4 and 5) and redirects these light rays to a filter surface while also redirecting filtered light rays out of the apparatus without their restriking a filter surface. In order to accomplish this the cusp is preferably made of four segments of a cylindrical surface and consists of four mirror surfaces on an appropriately shaped aluminum housing. The two segments 40 in this embodiment have a radius of curvature of about 3 inches. The segments 42 have a radius of curvature of about 3-½ inches.

Dichroic filters can be designed to most efficiently transmit and reflect light over different wave bands which peak at specific wavelengths as desired. One dichroic filter surface preferably used in this invention reflects UV over a band which peaks at 3700 angstrom most efficiently when light strikes the surface at a normal (90°) angle of incidence. The surfaces, however, are used so that most of the light emanating from the source 13 will strike the surface at 45°. At this angle UV over a band which peaks at 3478 angstrom wavelength is most efficiently reflected. The invention is predicated on arranging the dichroic filter surfaces so that substantially all the light will strike the surfaces at least once and that all the light leaving the assembly 11 strikes the surfaces only once. This is necessary because the second time a light ray strikes a filter surface it will do so in most cases at an angle of incidence different from the first angle of incidence; so that for example the UV band which peaks at 3478 angstrom formed by striking the surface at angle of incidence of 45° from normal, will almost all be transmitted if it strikes a second surface at an angle of incidence substantially different from 45°, thus defeating the object of the invention which is to reflect UV and transmit only I.R. light.

Having described the invention with reference to a preferred embodiment, it should be understood that minor modifcations can be made the parts or to the arrangement of such parts without departing from the spirit and scope of the invention.

What is claimed:

1. Apparatus for providing a high flux beam of substantially all ultraviolet light to a substrate comprising an elliptical-like reflector housing having an opening at one end and a first focal line;

a linear source of UV light mounted in said housing at the focal line thereof, the longitudinal axis of the line source being contained in a plane of symmetry of the apparatus which is perpendicular to the plane of the opening of said reflector housing;

a first optically flat dichroic surface on each side of said plane of symmetry mounted at one end of such dichroic flat surface adjacent said reflector housing opening;

a second optically flat dichroic surface on each side of said plane of symmetry connected to the other side of said first dichroic flat surface, said first and second dichroic flat surfaces providing a concave surface on each side of said plane of symmetry when viewed therefrom;

a cusp-like member mounted between said concave surfaces so that its longitudinal plane of symmetry coincides with the plane of symmetry of the apparatus and so that the cusp-like member is adjacent the reflector opening beyond the second focal line of said reflector housing whereby substantially all the UV light from said line source strikes a dichroic surface only once and and substantially all the UV light leaving the apparatus has struck a dichroic surface once.

2. Apparatus according to claim 1 wherein absorbers are located behind said dichroic flat surfaces to absorb substantially all the light transmitted through the dichroic surfaces.

* * * * *